US010605051B2

(12) United States Patent
Moja

(10) Patent No.: US 10,605,051 B2
(45) Date of Patent: Mar. 31, 2020

(54) METHOD OF PUMPING FLUIDS DOWN A WELLBORE

(71) Applicant: Unseated Tools LLC, Williston, ND (US)

(72) Inventor: Andrew T. Moja, Williston, ND (US)

(73) Assignee: Unseated Tools LLC, Williston, ND (US)

( * ) Notice: Subject to any disclaimer, the term of this patent is extended or adjusted under 35 U.S.C. 154(b) by 0 days.

(21) Appl. No.: 16/528,758

(22) Filed: Aug. 1, 2019

(65) Prior Publication Data

US 2019/0353007 A1 Nov. 21, 2019

Related U.S. Application Data

(63) Continuation-in-part of application No. 15/901,429, filed on Feb. 21, 2018.
(Continued)

(51) Int. Cl.
*E21B 31/18* (2006.01)
*E21B 34/14* (2006.01)
(Continued)

(52) U.S. Cl.
CPC ..... *E21B 34/14* (2013.01); *E21B 31/18* (2013.01); *E21B 37/06* (2013.01); *E21B 41/02* (2013.01); *E21B 43/26* (2013.01)

(58) Field of Classification Search
CPC ..... E21B 21/10; E21B 31/18; E21B 43/126
See application file for complete search history.

(56) References Cited

U.S. PATENT DOCUMENTS 1,576,597 A 3/1926 Goss
1,614,771 A 1/1927 Axelson et al.
(Continued)

FOREIGN PATENT DOCUMENTS

GB 2314391 A 12/1997

OTHER PUBLICATIONS

Cox, B.R. and B.J. Williams; Methods to Improve the Efficiency of Rod-Drawn Subsurface Pumps; SPE, conference-paper/SPE-18828-MS; Published Mar. 13, 1989, Society of Petroleum Engineers; Oklahoma City, Oklahoma; Retrieved Mar. 19, 2018, from URL: https://www.onepetro.org:443/conference-paper/SPE-18828-MS.
(Continued)

*Primary Examiner* — William D Hutton, Jr.
*Assistant Examiner* — Steven A MacDonald
(74) *Attorney, Agent, or Firm* — Peter Brewer; Thrive IP

(57) ABSTRACT

A method of pumping fluids down a wellbore. The method first comprises providing a wellbore. The wellbore has been completed with a pumping system comprising a string of production tubing, a polished rod, and a sucker rod string extending down into the production tubing. A traveling valve is connected at a lower end of the sucker rod string. The method also includes adjusting a position of the polished rod relative to the pumping system to enable the traveling valve to tag a standing valve. The method further comprises compressing the traveling valve to cause the traveling valve to open. The method additionally includes pumping a fluid down the production tubing. The fluid is further pumped across the traveling valve and the standing valve, optionally while the standing valve remains seated.

20 Claims, 10 Drawing Sheets

Related U.S. Application Data

(60) Provisional application No. 62/735,699, filed on Sep. 24, 2018, provisional application No. 62/523,424, filed on Jun. 22, 2017.

(51) Int. Cl.

| | |
|---|---|
| *E21B 43/26* | (2006.01) |
| *E21B 41/02* | (2006.01) |
| *E21B 37/06* | (2006.01) |

(56) References Cited

U.S. PATENT DOCUMENTS

| | | | | |
|---|---|---|---|---|
| 1,628,901 | A | 5/1927 | Neilsen | |
| 1,676,661 | A | 7/1928 | Neilsen | |
| 1,692,005 | A | 11/1928 | Tumer et al. | |
| 2,142,494 | A | 1/1939 | Cartwright | |
| 2,191,380 | A | 2/1940 | Hall | |
| 2,242,602 | A | 5/1941 | Watson | |
| 2,260,127 | A | 10/1941 | Tebbetts, Jr. | |
| 2,286,550 | A | 6/1942 | Kelly et al. | |
| 2,319,514 | A | 5/1943 | Penfield | |
| 2,605,131 | A | 7/1952 | Marshall et al. | |
| 2,647,008 | A | 7/1953 | Stewart et al. | |
| 3,208,531 | A | 9/1965 | Tamplen | |
| 3,358,765 | A | 12/1967 | Le Blanc | |
| 3,584,902 | A | 6/1971 | Vyse | |
| 3,606,402 | A | 9/1971 | Medney | |
| 3,918,679 | A | 11/1975 | Silvana | |
| 3,990,727 | A | 11/1976 | Gallagher | |
| 4,051,899 | A | 10/1977 | Fredd | |
| 4,391,547 | A | 7/1983 | Jackson, Jr. et al. NAME | |
| 4,436,125 | A | 3/1984 | Blenkush | |
| 4,524,998 | A | 6/1985 | Brisco | |
| 4,802,694 | A | 2/1989 | Vargo | |
| 4,848,454 | A | 7/1989 | Spears | |
| 4,944,345 | A | 7/1990 | Mashaw, Jr. | |
| 5,020,591 | A | 6/1991 | Shore | |
| 5,149,163 | A | 9/1992 | Pruitt | |
| 5,160,180 | A | 11/1992 | Mlynarczyk | |
| 5,197,773 | A | 3/1993 | Vick, Jr. | |
| 5,356,114 | A | 10/1994 | Havard | |
| 5,413,721 | A * | 5/1995 | Schmitt | B01D 29/15 210/747.1 |
| 5,494,109 | A * | 2/1996 | Schmitt | B01D 29/114 166/312 |
| 5,655,604 | A * | 8/1997 | Newton | E21B 43/12 166/105 |
| 5,871,296 | A | 2/1999 | Furukawa et al. | |
| 5,915,866 | A | 6/1999 | Furukawa | |
| 6,050,340 | A * | 4/2000 | Scott | E21B 23/00 166/105 |
| 6,196,309 | B1 | 3/2001 | Estilette, Sr. | |
| 6,340,261 | B1 | 1/2002 | Furukawa | |
| 6,554,320 | B2 | 4/2003 | Cresswell | |
| 6,764,103 | B1 | 7/2004 | Moretz | |
| 7,311,346 | B2 | 12/2007 | Bakke | |
| 7,775,291 | B2 | 8/2010 | Jacob | |
| 8,356,394 | B1 | 1/2013 | Heinle et al. | |
| 2004/0062657 | A1* | 4/2004 | Beck | E21B 43/126 417/42 |
| 2004/0131480 | A1 | 7/2004 | Tessier et al. | |
| 2009/0235730 | A1* | 9/2009 | Alapati | B08B 9/027 73/152.27 |
| 2009/0242195 | A1* | 10/2009 | Wicentovich | E21B 43/127 166/244.1 |
| 2013/0014951 | A1* | 1/2013 | Fitzpatrick | E21B 43/26 166/305.1 |
| 2014/0367101 | A1* | 12/2014 | Welton | E21B 43/267 166/280.2 |

OTHER PUBLICATIONS

Hendrix, James R. (Oilwell Div. of U.S. Steel Corp.); Subsurface Sucker-Rod Pumps (1987 PEH Chapter 8); SPE, book/peh/spe-1987-08-peh; Published Circa 1987; Society of Petroleum Engineers; Retrieved Mar. 19, 2018, from URL: https://ww.onepetro.org:443/book/peh/spe-1987-08-peh.

Pickford, K.H., and B.J. Moris; Hydraulic Rod-Pumping Units in Offshore Artificial-Lift Applications; SPE, journal-papers/SPE-16922-PA; vol. 4, No. 2; Published May 1989; Society of Petroleum Engineers; Retrieved Mar. 19, 2018, from URL: https://www.onepetro.org:443/journal-paper/SPE-16922-PA.

Moises, Gustavo, et al.; Sucker-Rod Pumping Failures Diagnostic System; SPE, conference-paper/SPE-134975-MS; Published Sep. 19, 2010; Society of Petroleum Engineers; Florence, Italy; Retrieved Mar. 19, 2018, from URL: https://www.onepetro.org:443/conference-paper/SPE-134975-MS.

Okoto, Francis, et al.; Recovery of Marginal Reserves through a Cement Packer within Two Production Packers in Dual Completion Strings; SPE, conference-paper/SPE-167530-MS; Published Aug. 5, 2013; Society of Petroleum Engineers; Lagos, Nigeria; Retrieved Mar. 19, 2018, from URL: https://www.onepetro.org:443/conference-paper/SPE-167530-MS.

W. H. Stone (Union Oil Co. of California); Installation of a Deep-Water, Subsea Completion System; SPE, journal-paper/SPE-6917-PA; vol. 30, No. 10; Published Oct. 1978; Society of Petroleum Engineers; Retrieved Mar. 19, 2018, from URL: https://www.onepetro.org:443/journal-paper/SPE-6917-PA.

J.F. McCafferty (Conoco Inc.); Importance of Compression Ratio Calculations in Designing Sucker Rod Pump Installations; SPE, conference-paper/SPE-25418-MS; Published Mar. 21, 1993; Society of Petroleum Engineers; Oklahoma City, Oklahoma; Retrieved Mar. 19, 2018, from URL: https://www.onepetro.org:443/conference-paper/SPE-25418-MS.

Screen Shots of a Farr Plunger Pumps Catalog; Published Jul. 2014; from http://www.muthpump.com; (copyright 2018).

Catalog of Pumps: Muth Pump Farr Plunger Pumps; Published Jul. 2014; Retrieved Mar. 19, 2018, from URl: http://www.muthpump.com/farr-plunger/.

Lester C. Uren; Principles of Deep Well Pumping; SPE-925130-G; vol. G-25, No. 01; Published Dec. 1925; Society of Petroleum Engineers; Retrieved Mar. 19, 2018, from URL: https://www.onepetro.org/journal-paper/SPE-925130-G.

Juch, A.H. and R.J. Watson; New Concepts in Sucker-Rod Pump Design; SPE-2172-PA; vol. 21, No. 03; Published Mar. 1969; Society of Petroleum Engineers; Retrieved Mar. 19, 2018, from URL: https://www.onepetro.org/journal-paper/SPE-2172-PA.

Selected pages from Dura Products Catalog; Retrieved Mar. 19, 2018; now published at URL: https://www.distributionnow.com/content/documents/products/Dura_-_Product_Catalog.pdf.

* cited by examiner

METHOD OF PUMPING FLUIDS DOWN A WELLBORE

STATEMENT OF RELATED APPLICATIONS

This application claims the benefit of U.S. Ser. No. 62/735,699 entitled "Method of Pumping Fluids Down a Wellbore." That application was filed on Sep. 24, 2018, and is incorporated herein in its entirety by reference.

This application is also filed as a Continuation-In-Part of U.S. Ser. No. 15/901,429 entitled "Unseating Tool for Downhole Traveling Valve." That application was filed on Feb. 21, 2018, and is incorporated herein in its entirety by reference.

That application claimed the benefit of U.S. Ser. No. 62/523,424 entitled "Unseating Tool For Downhole Traveling Valve." That application was filed on Jun. 22, 2017, and is also incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to a method of pumping fluids down a wellbore to provide chemical or thermal treatment, wherein the wellbore includes a downhole pump.

DISCUSSION OF TECHNOLOGY

When a hydrocarbon-producing well is first placed on-line, the formation pressure is typically capable of driving produced fluids up the wellbore and to the surface. Liquid fluids will travel up to the surface through the production tubing, primarily in the form of droplets entrained within gas flow. The fluids are received at the wellhead without the assistance of so-called artificial lift equipment.

During the life of the well, the natural reservoir pressure will decrease as gases and liquids are removed from the formation. As the natural downhole pressure of the well decreases, the gas velocity moving up the well drops below a so-called critical flow velocity. In addition, the hydrostatic head of fluids in the wellbore will work against the formation pressure and block the flow of in situ gas into the wellbore. The result is that formation pressure is no longer able, on its own, to force fluids from the formation and up the production tubing in commercially viable quantities.

In response, various remedial measures have been taken by operators. One option is to simply reduce the inner diameter of the production tubing a small amount, thereby increasing pressure differential. Another technique is through the use of a downhole reciprocating pump. Such pumps include a first valve that is attached to the bottom of the tubing string. Such a valve is referred to as a standing valve. Such pumps also include a second valve that is connected to a lower end of a string of sucker rods. Such a valve is referred to as a traveling valve.

In operation, the sucker rods are moved up and down within the production tubing in response to mechanical movement of a pumping unit at the surface. Various types of pumping units are known, with modern pumping units being fitted with rod pump controllers that control pump times and stroke speeds. The sucker rods move the traveling valve through upstrokes and down strokes, where fluids are drawn into the traveling valve on the down stroke, and then lifted up the production tubing on the upstroke. At the same time, the standing valve receives fluids from the surrounding formation during the traveling valve's upstroke, and is sealed in response to fluid pressure during the traveling valve's down stroke.

The rod string, the traveling valve and the seated valve may together be referred to as a "sucker rod pump," or a "rod-drawn pump." The sucker rod pump along with the pumping unit at the surface and the production tubing in the wellbore together comprise a fluid pumping system.

As noted, the traveling valve portion of the pump is connected to the end of the sucker rod string. Typically, an upper portion of the traveling valve is threadedly connected to a plunger, which in turn is connected at the lower end of the sucker rod string. At the same time, the standing valve portion of the pump resides along an inner diameter of the production tubing, below the traveling valve. Specifically, the standing valve is connected to a barrel having a seal assembly.

The standing valve is typically installed by attaching it to a running tool at the lower end of the traveling valve. This means that the standing valve portion is run into the wellbore with the traveling valve at the end of the rod string. Upon reaching a point of frictional engagement (or "seating nipple") between the standing valve and the surrounding production tubing, the weight of the traveling valve and rod string are released from the surface, down onto the standing valve.

In operation, the operator slacks off on the weight of the rod string. This allows gravity to drop the standing valve down onto the seating nipple. The operator may repeat this process several times, in effect "tapping" the standing valve into place until the seal assembly becomes firmly wedged into the internal constriction formed by the seating nipple. The standing valve is now fixed within the production tubing.

From time to time an operator may wish to inject fluids down the wellbore below the standing valve. This would be for the purpose of placing a formation treatment downhole. Such a formation treatment may be an acid treatment or a so-called hot oil treatment.

Alternatively, the operator may wish to circulate a chemical down to the standing valve. This would be for the purpose of treating the valve and related hardware for scale or corrosion.

In either instance, before conducting the fluid pumping operation the operator will typically first "kill the well." This means that a higher density mud-based fluid will be pumped into the well to provide a hydrostatic head over the formation. This will stop reservoir fluids from flowing to the surface when the wellhead is opened at the surface. The operator will then open the stuffing box and pull the rod string and connected traveling valve.

Those of ordinary skill in the art will understand that the process of pulling the rod string and traveling valve can be quite messy. Great quantities of kill-mud are spilled at well heads each year as a downhole tool string is lifted out of the well, carrying reservoir and wellbore fluids with it.

Therefore, a need exists for a procedure by which a treatment fluid may be pumped into the wellbore without lifting the rod string and connected traveling valve out of the hole. In addition, a need exists for a method of opening a traveling valve, and then pumping flushing fluids or treatment fluids down a wellbore, through the traveling valve and then through the standing valve, without pulling the rod string or removing the standing valve from the wellbore.

SUMMARY OF THE INVENTION

A method of pumping fluids down a wellbore is provided herein. In one aspect, the method first comprises providing a wellbore. The wellbore has been completed with a fluid pumping system. The pumping system generally comprises:

a polished rod, a string of production tubing, a sucker rod string extending from the polished rod and down into the production tubing, a traveling valve residing at a lower end of the sucker rod string, and a standing valve residing within the production tubing below the traveling valve.

In a preferred embodiment, the pumping system will include a pumping unit. The pumping unit may be either a mechanical pumping unit such as a so-called rod beam (or sometimes "rocking beam") unit. Alternatively, the pumping unit may be a linear pumping unit that uses hydraulic fluid or pneumatic fluid to cyclically act against a piston within a cylinder. In either instance, the pumping unit will use clamps and a harness to secure the pumping unit to the polished rod.

The method also includes adjusting a position of the polished rod relative to the pumping system. Adjusting a position of the polished rod may comprise adjusting a location at which the harness is secured to the polished rod. This enables the sucker rod string and connected traveling valve to travel lower into the production tubing on a down stroke.

The method further comprises providing a down stroke for the pumping system. The down stroke enables the traveling valve to tag the standing valve. The result is that the traveling valve bumps into or "tags" the standing valve. Preferably, this step is conducted by an operator manually moving the pumping system on its down stroke.

The method further includes compressing the rod string. Compressing the rod string means that tagging the standing valve as part of the down stroke compresses the rod string and traveling valve against the standing valve. This too is done by the operator manually at the surface. The result is that both the traveling valve and the standing valve are opened.

In one aspect, the rod string is compressed by at least two inches. This provides visual confirmation to the operator that the valves have opened.

The method additionally includes pumping a fluid down the production tubing. The fluid is further pumped down across the traveling valve while the standing valve remains seated in the seating nipple. Optionally, the fluid is also pumped through the standing valve and further down the wellbore.

In one aspect, the fluid that is pumped down the production tubing is a treatment fluid. The treatment fluid may be a chemical designed to treat the valves, tubing, rod string and other hardware for scale or corrosion. The treatment fluid may alternatively be an acid designed to treat a subsurface formation below the standing valve. In that instance, the method may include further flushing the fluid out of the wellbore and into the subsurface formation under pressure. Care must be taken here not to comprise the formation by over-pressuring the fluid downhole.

In another aspect, the fluid that is pumped down the production tubing is a so-called kill fluid. In this instance, the method further comprises killing the well using the kill fluid. This may be done before a treatment fluid is pumped.

The method may optionally include pulling the sucker rod string and connected traveling valve from the wellbore once the well has been killed. The operator may optionally remove the polished rod as well. The operator may further optionally remove the traveling valve with the standing valve. Beneficially, the traveling valve and the standing valve may be pulled together using the engagement pin and standing valve puller described below.

In any instance, the method may further comprise moving the harness and clamps to an original position along the polished rod after the treatment fluid has been pumped down the production tubing. This, of course, assumes that the sucker rods and valves are back in the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
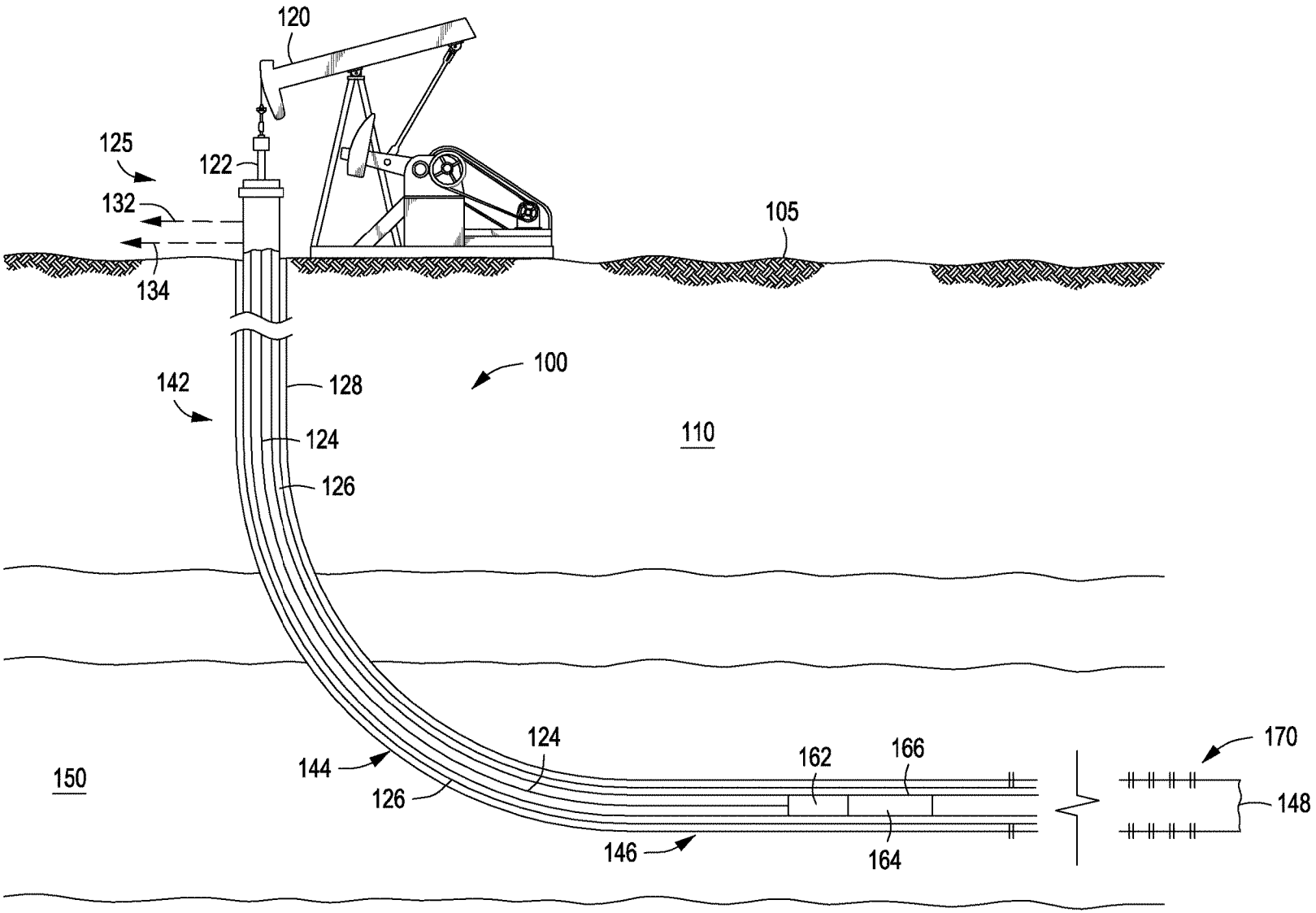
FIG. 1 is a side view of an illustrative wellbore. In this case, the wellbore is completed horizontally. A traveling valve is shown at a lower end of a sucker rod string while a standing valve is schematically shown in the production tubing.

For purposes of the present application, it will be understood that the term "hydrocarbon" refers to an organic compound that includes primarily, if not exclusively, the elements hydrogen and carbon. Examples of hydrocarbon-containing materials include any form of oil, natural gas, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state. The term hydrocarbon fluids may include other elements, such as, but not limited to, halogens, metallic elements, nitrogen, oxygen, and/or sulfur.

As used herein, the term "fluid" refers to gases, liquids, and combinations of gases and liquids, as well as to combinations of gases and fine solids, and combinations of liquids and fine solids.

As used herein, the terms "produced fluids," "reservoir fluids" and "production fluids" refer to liquids and/or gases removed from a subsurface formation, including, for example, a hydrocarbon reservoir, a shale formation or an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, carbon dioxide, hydrogen sulfide and water (including steam).

As used herein, the term "wellbore fluids" means water, hydrocarbon fluids, formation fluids, or any other fluids that may be within a string of production tubing during a production operation.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular" or "tubular member" refer to any pipe, such as a joint of casing, a portion of a liner, a joint of tubing, a pup joint, or coiled tubing. The terms "production tubing" or "tubing joints" refer to any string of pipe through which reservoir fluids are produced.

DESCRIPTION OF SPECIFIC EMBODIMENTS

FIG. 1 is a side view of a wellbore 100. The wellbore 100 has been formed for the purpose of producing hydrocarbon fluids up to a surface 105 in commercially viable quantities. The wellbore 100 is formed through an earth subsurface 110, and down to a formation 150 where hydrocarbon fluids are found. The formation 150 may be referred to as a "pay zone."

Production fluids flow into the wellbore 100 through openings provided along the completion. Such openings may be perforations, or optionally, may be formed with sand screens, ICDs, a gravel pack, an open hole, or other completion type. In the illustrative arrangement of FIG. 1, the end completion is shown with slotted liner 170.

Fluids are produced to the surface 105 through the use of a pumping unit 120. The pumping unit 120 is disposed over a well head 125 which receives the produced fluids including hydrocarbons at the surface 105. Typically, the well 100 will produce primarily hydrocarbon fluids that are incompressible at surface conditions, e.g., oil and water, but there will also be compressible hydrocarbon fluids such as methane, ethane and steam. So-called impurities such as hydrogen sulfide and oxygen may also be present which will need to be separated out after production to meet pipeline specifications.

In the example shown in FIG. 1, the pumping unit 120 is a mechanical beam pump. Of course, it is understood that the pumping unit 120 may alternatively be a pneumatic or hydraulic pumping unit. The pumping unit 120 moves a polished rod 122 up and down at the surface 105, through the well head 125. The polished rod 122, in turn, is connected to a rod string 124 that extends down through the earth subsurface 110.

The rod string 124 reciprocates within a string of production tubing 126. It is understood that both the rod string 124 and the production tubing 126 reside within a casing string (shown as a single string of pipe at 128). In reality, the wellbore 100 will comprises a series of casing strings, each having a progressively smaller inner diameter. The casing strings are cemented into place along most, if not all, of the wellbore completion.

Primarily liquids are pumped through the production tubing 126 and to the surface 105, and released through line 132. Primarily gas is produced up an annulus between the production tubing 126 and the casing 128, and released through line 134.

The illustrative wellbore 100 of FIG. 1 has been completed horizontally. This means the wellbore 100 has a vertical section 142 and a horizontal section 146. A transition section 144, sometimes referred to as a heel or a "build section," is formed between the vertical 142 and horizontal 146 sections. The horizontal section 146 extends along the pay zone 150, and terminates at a toe 148. Pumps are typically landed in the build section 144, preferably as deep as possible, and preferably close to the horizontal section 146.

It is observed that advances in drilling technology have enabled oil and gas operators to "kick-off" and steer wellbore trajectories from a generally vertical orientation to a generally horizontal orientation. The horizontal "leg" of wellbores completed in North America now often exceeds a length of one mile, and sometimes two or even three miles. This significantly multiplies the wellbore exposure to the pay zone 150.

It is also noted that horizontal wellbores are frequently formed along the deposition plane of a formation. Formation fracturing operations are then conducted in states, with fractures generally propagating vertically into the pay zone. The ability to replicate multiple vertical completions along a single horizontal wellbore is what has made the pursuit of hydrocarbon reserves from unconventional reservoirs, and particularly shales, economically viable within relatively recent times.

At the end of the rod string 124 are two valves. These represent a traveling valve 162 and a standing valve 164. As discussed above, the traveling valve 162 is connected at the end of the rod string 124 (usually by means of a plunger) and moves with the rod string 124, while the standing valve 164 is frictionally and releasably secured to a seating nipple 166 (usually by means of a barrel and circumferential seal member) along the production tubing 126.

It is desirable to be able to pump fluids down the wellbore 100 without pulling the rod string 124 and the traveling valve 162. Accordingly, a novel method of pumping fluids down a wellbore is provided herein.

Figure 2A:
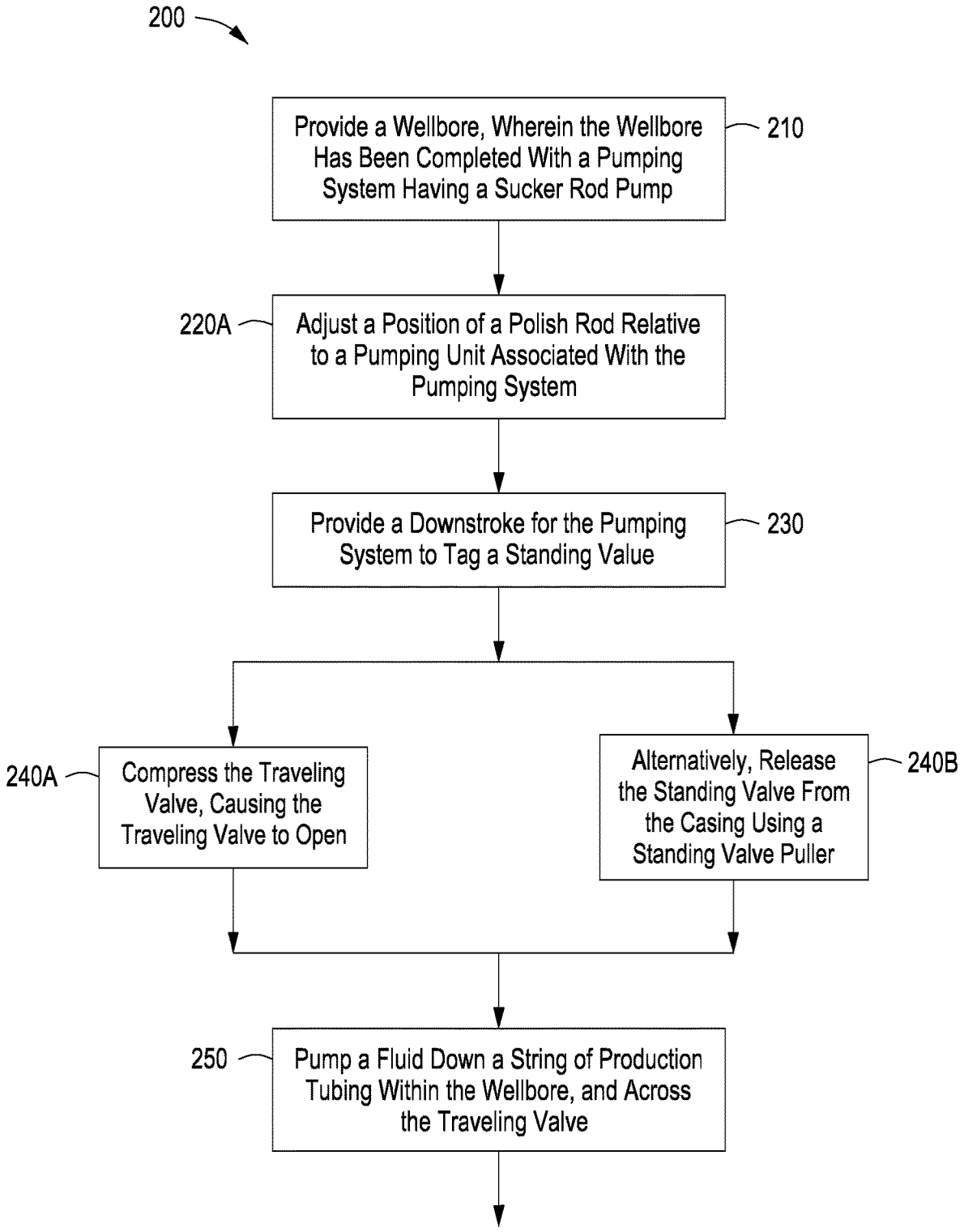
FIGS. 2A and 2B represent a single flow chart showing steps for a method of pumping fluids down a wellbore, in one embodiment.
Figure 2B:
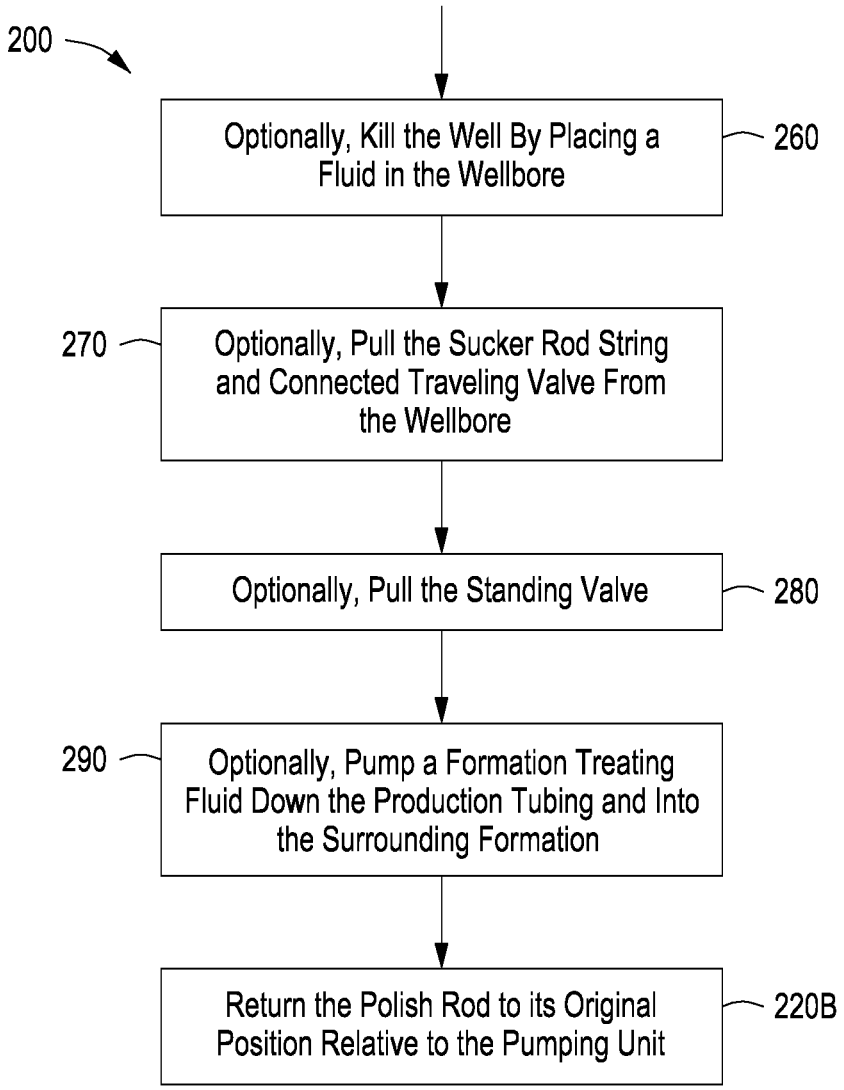

FIGS. 2A and 2B represent a single flow chart showing steps for a method 200 of pumping fluids down a wellbore, in one embodiment. In one aspect, the method 200 first comprises providing a wellbore. This step is shown at Box 210.

In accordance with the step of Box 210, the wellbore has been completed with a pumping system. The pumping system generally comprises:

a polished rod, a string of production tubing within the wellbore, a sucker rod string extending from the polished rod and down into the production tubing, a traveling valve residing at a lower end of the sucker rod string, and a seated valve (such as a standing valve) below the traveling valve.

The traveling valve, the seated valve and the rod string may together be referred to as a "sucker rod pump" or "rod-drawn pump."

The pumping system is provided to move the sucker rod string and connected traveling valve in cyclical fashion. This means the pumping system will provide an upstroke and a down stroke. The speed at which the upstroke and the down stroke take place may be preset by the operator and periodically adjusted. Alternatively, the speeds may be adjusted by a rod pump controller located at the well head in response to real time load cell readings or manual override settings.

In a preferred embodiment, the pumping system will include a pumping unit. The pumping unit may be either a mechanical pumping unit such as a so-called "rocking beam" unit. Alternatively, the pumping unit may be a linear pumping unit that uses hydraulic or pneumatic fluid to cyclically act against a piston within a cylinder. In any instance, the pumping unit will use clamps and a harness to secure the pumping unit to the polished rod.

It is noted that the step of Box 210 for "providing" a wellbore may include a service company contracting to service the wellbore. Alternatively, providing the wellbore may mean that an operator produces from the wellbore and services the wellbore itself.

The method 200 also includes adjusting a position of the polished rod relative to the pumping system. Specifically, clamps associated with the pumping rod system are moved up the polished rod. This is provided in Box 220A. The step of Box 220A enables the sucker rod string and connected traveling valve to travel lower into the production tubing on a down stroke.

It is understood that for purposes of the step of Box 220, moving the polished rod may comprise moving a pup joint or other tubular body that is operatively connected below the polished rod.

The method 200 next includes providing a down stroke for the pumping system. This is shown in Box 230. The down stroke causes the traveling valve to bump ("or tag") the standing valve downhole. This step of Box 230 may be done manually by the operator or service company at the surface.

It is understood that for purposes of Box 230, the traveling valve itself need not directly contact the standing valve. In this respect, there may be one or more tools residing below the traveling valve such as an engagement pin (shown in FIGS. 3 and 4 and discussed below). Similarly, there may be one or more tools residing above the standing valve such as standing valve puller (also shown in FIG. 3 and in part in FIG. 4 and discussed below). Thus, the step of Box 230 contemplates in one aspect that tagging occurs through one or more intermediate tools.

In connection with the down stroke (or tagging) step of Box 230, the method 200 further comprises compressing the traveling valve. This is indicated at Box 240A. Compressing the traveling valve means that the rod string acts downwardly against the standing valve. The traveling valve is sandwiched between the rod string and the standing valve, resulting in an incidental compression.

It is known in the industry to include two traveling valves at the end of a rod string. In the compression step, each traveling valve may be compressed simultaneously. In one aspect, opening the traveling valve is provided wherein compression of the rod string by about two inches causes the traveling valve to open. Optionally, this compressive force also causes the standing valve to open.

U.S. Pat. No. 4,848,454 discloses one embodiment of a traveling valve that opens in response to compressive force. In that instance, compressive force is caused by fluid pounding. This arrangement prevents gas lock during production. The '454 patent is incorporated herein by reference in its entirety.

A more modern arrangement for a traveling valve that can open in response to a compressive force is presented in the Stinger® valve, provided by Drilling Tools International of Houston, Tex. The Stinger® valve is a rotary lock traveling valve used in artificial lift wells. The Stinger® valve has upper threads that connect directly to the valve rod, and lower threads that interface with a standard plunger. The Stinger® valve reciprocates over a standard standing valve.

In any instance, once the traveling valve is compressed, the operator may pump fluids down the wellbore, through the opened traveling valve and through the standing valve without pulling the traveling valve and standing valve. The standing valve remains seated in the seating nipple.

As an alternative to using a traveling valve and/or standing valve that opens in response to a compressive force, the operator may use a custom standing valve puller to pull the standing valve from its seating nipple. This is shown in Box 240B. Operation of a standing valve puller is described more fully below in connection with Box 280. In connection with the step of Box 240B, neither the traveling valve nor the standing valve are pulled from the production tubing 126. In contrast, in the optional step of Box 280, the traveling valve and the standing valve are pulled from the wellbore together using the rod string.

In either instance, the method 200 additionally includes pumping a fluid down the production tubing. The fluid is further pumped down through the traveling valve and across the standing valve. This is shown in Box 250. The fluid that is pumped down the production tubing is a treatment fluid. In one aspect, the step of Box 250 includes providing treatment to the valves of the pump. The treatment fluid is a chemical solution designed to remove deposits of corrosion or scale. Those of ordinary skill in the art will understand that scale is a deposit that can form along the production tubing, valves, rod string joints and other downhole completion equipment. Scale may be removed by pumping, for example, hydrochloric acid, ethylenediamenetetra-acetic acid (or EDTA), or a combination thereof.

In another aspect, the fluid that is pumped down the production tubing in Box 250 is a so-called kill fluid. In this instance, the method 200 further comprises killing the well using the kill fluid. This is provided in Box 260. The kill fluid may be a weighted fluid such as drilling mud or brine mixed with drilling mud or other weighting agent.

After the well is killed, the method 200 may optionally include pulling the sucker rod string and connected traveling valve from the wellbore. This is offered in Box 270. This allows the operator to inspect and possibly replace the traveling valve and any noticeably worn joints of sucker rod.

The method 200 may further comprise pulling the standing valve. This is seen at Box 280. Pulling the standing valve in this step means pulling the standing valve completely out of the wellbore. In this instance, the operator may inspect the traveling valve for possible maintenance needs or replacement.

Pulling the standing valve 164 out of the wellbore 100 may beneficially be done by using a tool that is run in on a working string after the sucker rod string 124 has been removed according to Box 270. More preferably, pulling the standing valve 164 is done by using a specially-designed standing valve puller that resides at the top of the standing valve 162. Such a standing valve puller is described in the parent application, and is shown at 100 in FIG. 1 of U.S. Ser. No. 15/901,429.

Figure 3:
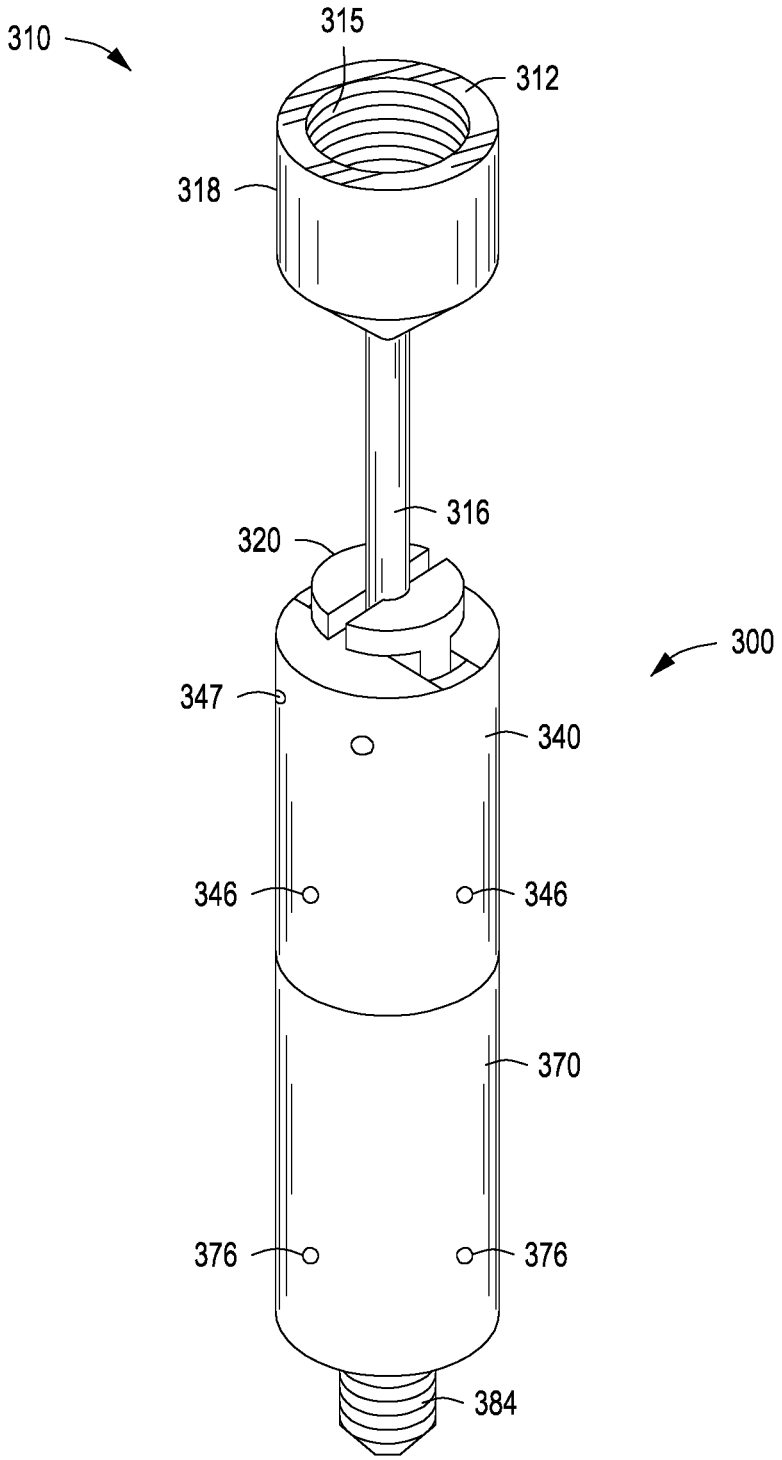
FIG. 3 is a perspective view of standing valve puller as may be used for removing a standing valve from a wellbore.

FIG. 3 is a perspective view of the standing valve puller 300 of the parent application. The standing valve puller 300 is designed to be used to remove a standing valve (such as standing valve 164) from a wellbore 100. This is done by using the rod string 124, the traveling valve 162 and an engagement pin 310, wherein the engagement pin 310 resides at the lower end of the traveling valve 162 and releasably connects to the standing valve puller 300.

The standing valve puller 300 resides within the wellbore 100 during a production operation. More specifically, the standing valve puller 300 threadedly connects to the standing valve 164 using the existing threaded opening at the top of the standard standing valve 164. The connection is made by hand at the surface before the standing valve 164 is run into the wellbore 100 and seated in the seating nipple 166.

The standing valve puller 300 will remain connected to the standing valve 164 within the wellbore 100 during production. At the same time, the engagement pin 310 remains connected to the bottom of the traveling valve 162 and, accordingly, will cycle with the sucker rods 124. The engagement pin 310 provides a "latch and release" arrangement with the standing valve puller 100.

In a preferred embodiment, the standing valve puller 300 is no more than 15 to 24 inches in length, measured from a top 322 of the holding arm component 320 to a bottom 384 of a threaded end connector. In addition, the standing valve puller 300 will have an outer diameter no greater than the outer diameter of the standing valve 164 itself. For example, the standing valve puller 300 may have an outer diameter (measured across the housings 140/170) of about 2.0 inches. Therefore, the standing valve puller 300 will not create a restriction to either run-in or to normal wellbore operations. The standing valve puller 300 replaces the threaded connection between the traveling valve and the standing valve.

Figure 4:
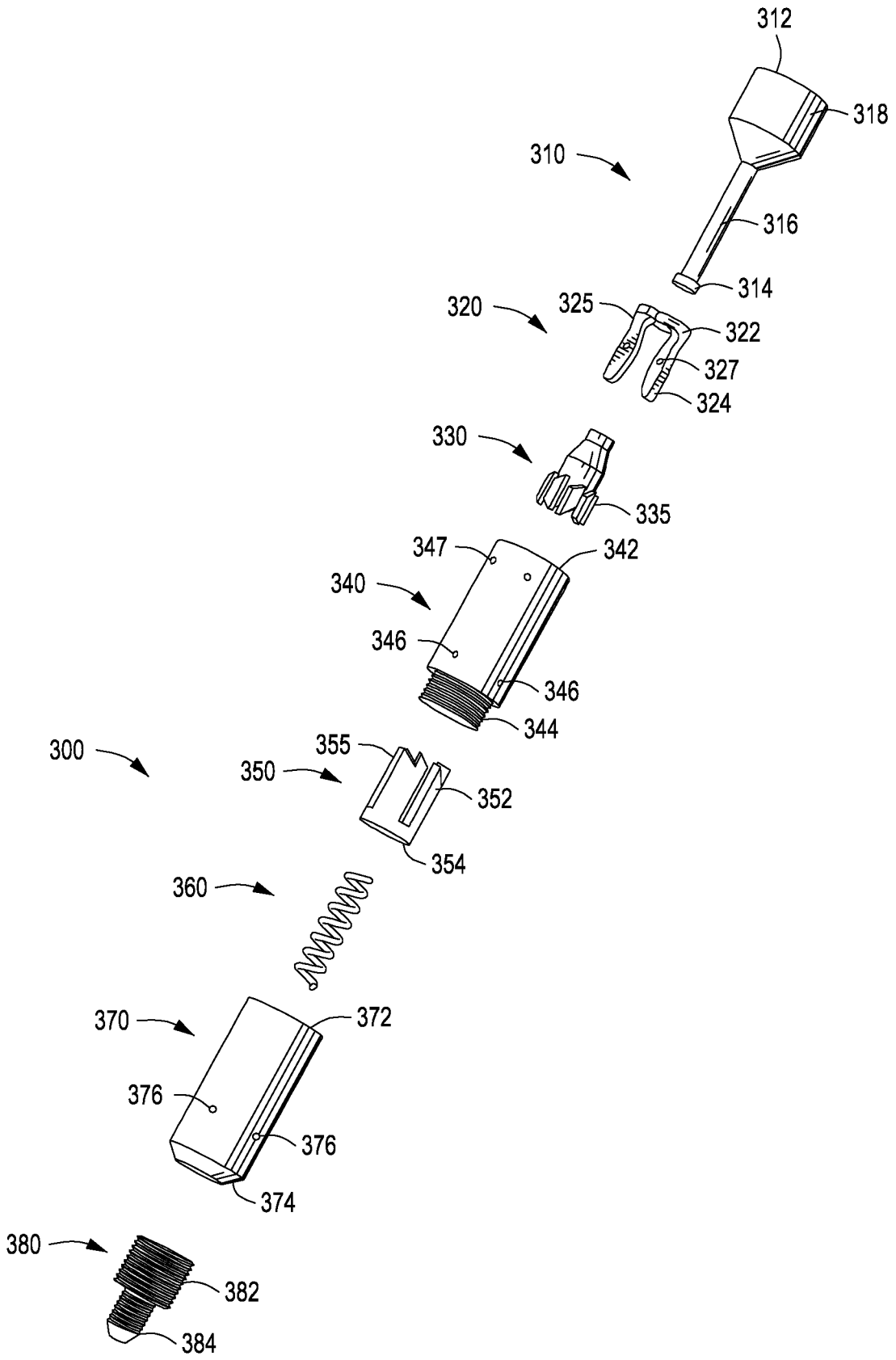
FIG. 4 is an exploded view of the standing valve puller of FIG. 3 along with the engagement pin. Internal components of the standing valve puller are now visible in exploded-apart relation.

FIG. 3 shows an engagement pin 310 latched into the standing valve puller 300. The engagement pin 310 defines an elongated body comprising a proximal (or upper) end 112 and a distal (or lower end) 314. (The distal end 314 is seen in FIG. 4.) Between the proximal end 312 and the distal end 314 is a stem 316. Preferably, the stem 316 is about three inches in length.

In the view of FIG. 3, the engagement pin 310 is seen extending down into the standing valve puller 300. More specifically, the stem 316 has passed through a top of the standing valve puller 300. Applying a downward force onto the engagement pin 310 (applied through the rod string 124) causes the elongated stem 316 to move down into the standing valve puller 300. The standing valve puller 300 is designed in such a way that the downward force will cause arms (shown at 325 of FIG. 4) at the top of the puller 300 to pivot inwardly and to latch onto the stem 316. Beneficially, applying the same downward force to the engagement pin 310 a second time will cause the arms 325 to pivot away from the stem 316 and to release the engagement pin 310 from the standing valve puller 300. In this way, a "latch and release" cycle is provided that may be performed quickly and repetitively.

FIG. 4 offers an exploded view of the standing valve puller 300 of FIG. 3. Internal components of the standing valve puller 300 are now visible. These include a holding arm component 320, a sliding component 330, a top housing 340, a twisting component 350, a spring 360, a bottom housing 370 and the threaded connector 380.

Along with the standing valve puller 300 and its components, FIG. 4 shows the engagement pin 110 in its entire length. In FIG. 4, the distal end 314 is now seen. The distal end 314 defines a shoulder. When the engagement pin 310 is pulled by the operator from the surface, the shoulder 314 will catch on the arms 325 of the holding arm component 320. More specifically, the shoulder 314 will hit flanges at a proximal end 322 of the holding arms 320 when in their latched position. This is more readily seen in the side view of FIG. 5A, discussed below.

Referring to the holding arm component 320, it is observed that the holding arm component 320 comprises two or more separate arms 325. Each arm 325 has a proximal end 322 and a distal end 324. As noted, the distal end 322 represents a flange used to catch the shoulder 314 of the engagement pin 310 when the holding arm component 320 is in its latched position.

In addition, each arm 325 has a pivot hole 327. Each pivot hole 327 is dimensioned to receive a respective horizontal pin (not shown). The respective pins reside proximate a top 342 of the top housing 340. The horizontal pins allow the arms 325 to pivot inwardly and outwardly relative to the top housing 340.

The standing valve puller 300 next includes the sliding component 330. The sliding component 330 comprises a generally tubular body wherein splines 335 are placed radially around an outer diameter. As the name implies, the sliding component 330 is configured to move (or slide) longitudinally along the standing valve puller 300. Specifically, the splines 335 slide along channels 346 disposed along an inner diameter of the top housing 340. Two of the channels 346 are seen in FIG. 7B.

Next shown in FIG. 4 is the top housing 340. The top housing 340 is a tubular body comprising a proximal end 342 and a distal end 344. The proximal end 342 includes pivot holes 347 that receive the horizontal pivot pins. In the preferred embodiment, two horizontal pins are used, requiring two pairs of pivot holes 347 located on each side of the top housing 340. In this way, the two opposing arms 325 are pivotally supported.

Figure 7A:
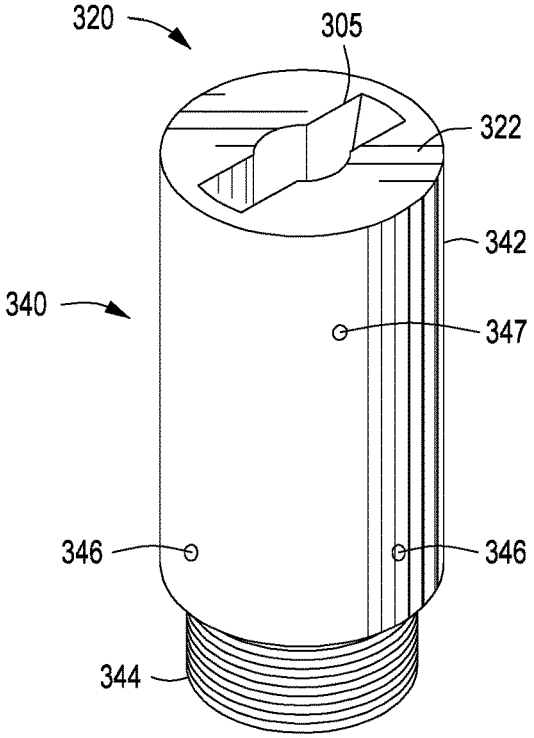
FIG. 7A is a perspective view of a top housing component of the standing valve puller of FIG. 3, in one embodiment. Two arms are shown nested at the upper end of the top housing component.
Figure 7B:
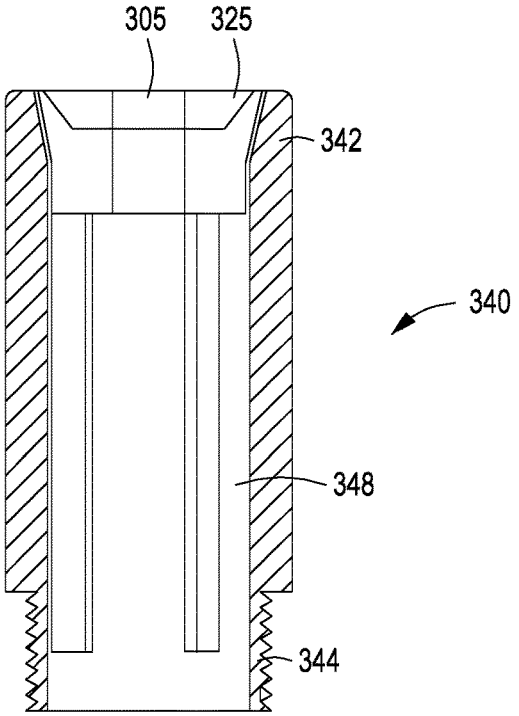
FIG. 7B is a cross-sectional view of the top housing component of FIG. 7A. Here, the arms have been removed.

The proximal end 342 of the top housing 340 defines a pair of slanted surfaces (seen best in FIG. 7B). The slanted surfaces are dimensioned to receive the respective arms 325 when they are pivoted outwardly. Preferably, the arms 325 are biased to pivot outwardly through the use of respective springs (not shown).

The distal end 344 of the top housing 340 comprises a male threaded member. The male threads at the distal end 344 connect to a proximal end 372 of the bottom housing 370, described further below.

FIG. 4 next shows a twisting component 350. The twisting component 350 also represents a somewhat tubular body. The twisting component 350 comprises a proximal end 352 and a distal end 354. Along the tubular body of the twisting component 350 are longitudinal slots. The slots alternate between long slots and short slots (identified as slots 351 and 357, respectively, in FIG. 6B). Regardless of their length, the slots 351, 357 are dimensioned to slidably receive the splines 335 of the sliding component 330.

Next shown in FIG. 4 is the spring 360. The spring 360 resides within the bottom housing 370. The spring 360 is maintained in compression between a shoulder 383 (visible in FIG. 5B) of the threaded connector 380 and a corresponding shoulder 353 (also visible in FIG. 5B) of the twisting component 350. The spring 360 urges the twisting component 350 upward against the sliding component 330. Stated another way, the spring 360 is used to bias the twisting component 350 into engagement with the twisting component 330. The spring 360 is preferably fabricated from steel.

FIG. 4 next presents the bottom housing 370. As described above, the bottom housing 370 is a tubular body having a proximal end 372 and a distal end 374. The proximal end 372 comprises female threads configured to connect to the male threaded end 344 of the top housing 340. Similarly, the distal end 374 comprises female threads configured to connect to male threads at the proximal end 382 of the threaded connector 380.

It is noted that one or more holes 376 may be drilled into the bottom housing 370. This allows the standing valve puller 300 to be flushed out, either after the puller 300 has been retrieved to the surface, or in response to a hot oil treatment or chemical treatment wherein fluid is injected downhole.

Finally, FIG. 4 shows the threaded connector 380. The threaded connector 380 provides a means for connecting the standing valve puller 300 with the standing valve 164. The threaded connector 380 includes a distal end 384, discussed above in connection with FIG. 3.

In the view of FIG. 4, the threaded connector 380 is shown as a separate component from the bottom housing 370. However, it is understood that the threaded connector 380 may be integral to the bottom housing 370, meaning that the distal end of the housing 370 is actually the threaded male tip 384.

Figure 5A:
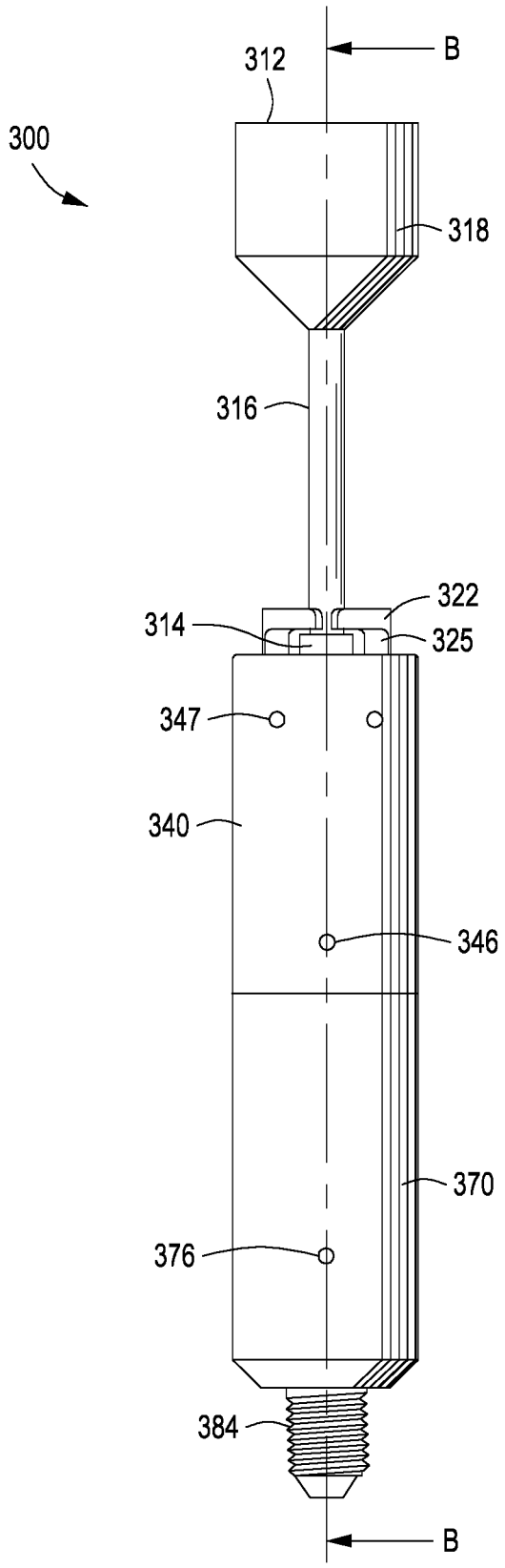
FIG. 5A is a side view of the standing valve puller and the engagement pin of FIG. 3. The standing valve puller is in its "latched" position, meaning that arms of a holding arm component have pivoted inwardly to engage a stem of the engagement pin.

FIG. 5A is a side view of the standing valve puller 300 of FIG. 3. The tubular housing (components 340/370 together) is shown, with the top housing 340 and bottom housing 370 being connected. In addition, the flanges 322 of the arms 325 are shown extending up from the top housing 340.

Also visible in FIG. 5A is the engagement pin 310. It can be seen that the shoulder 314 of the engagement pin has engaged the flanges 322 from underneath. This indicates that the engagement pin 310 is being pulled upward.

Figure 5B:
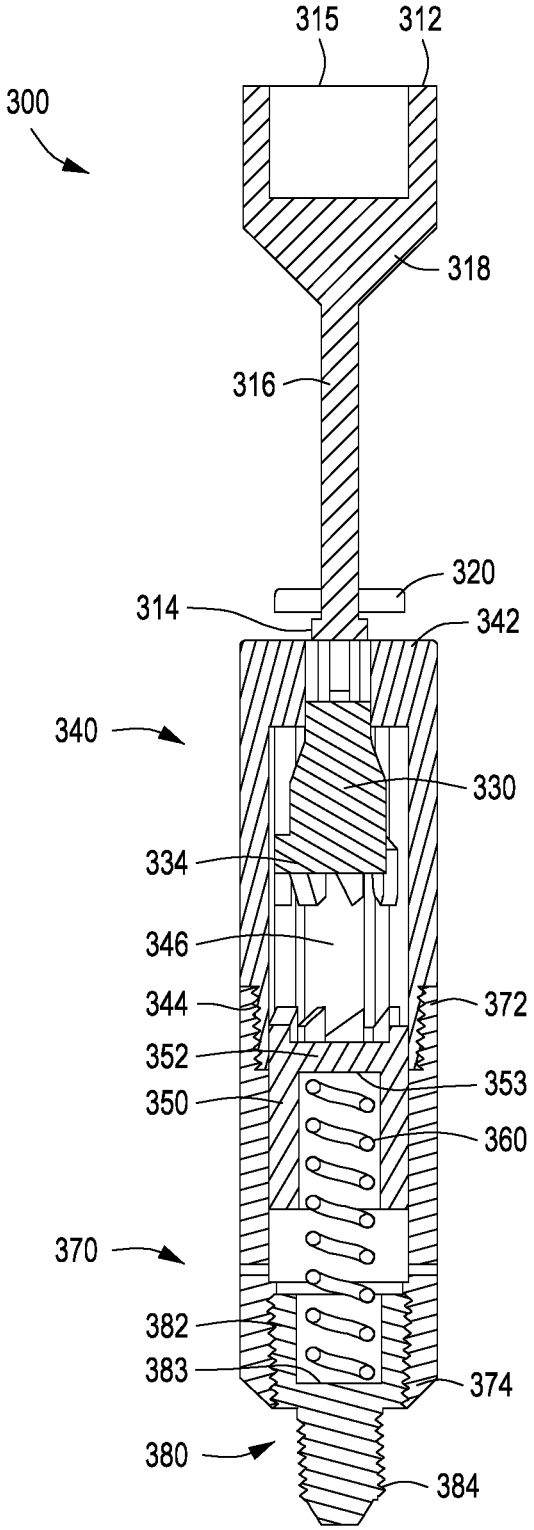
FIG. 5B is a cross-sectional view of the standing valve puller and the engagement pin, taken across Line B-B of FIG. 5A. The standing valve puller is again in its latched position, enabling the engagement pin to pull the standing valve puller and connected standing valve (not shown) from a wellbore.

FIG. 5B is a cross-sectional view of the standing valve puller 300 and the engagement pin 310 of FIG. 5A. The view is taken across Line B-B of FIG. 5A. In this view, the standing valve puller 300 is in a latched position, enabling the shoulder 314 of the engagement pin 310 to "catch" the flanges 322 of the respective arms 325 and pull the standing valve puller 300 and connected standing valve 164 up from a wellbore 100.

Of interest, FIG. 5B shows the spring 360 residing between the shoulder 383 of the threaded connector 380 and the shoulder 353 of the twisting component 350. Here, the spring 360 is not being compressed. The interrelationship between a distal end 334 of the sliding component 330 and a proximal end 352 of the twisting component 350 can also be inferred. When the sliding component 330 is pushed down through the channels 346 in the top housing 340, the toothed profile of the distal end 334 of the sliding component 330 will engage the mating toothed profile of the proximal end 352 of the twisting component 350. This will induce a rotation of the twisting component 350, which radially advances the slots 355 of the twisting component 350 from long 357 to short 351 to long 357, etc. In one aspect, a lower end of the splines 335 is angled, such as at 45-degrees, to urge rotation of the twisting component 350 when the twisting component 350 is acted upon by the sliding component 330.

As the sliding component 330 is forced downward by the engagement pin 310, it will rotate the twisting component 350 into a next position. In the latched position, the sliding component 330 will be forced upwards from the twisting component 350 into the holding arm component 320, under the force of the spring 360 as shown in FIG. 5B. This prevents the arms 325 from pivoting outwardly into the slanted surfaces 342. In the disengaged, or released, position the sliding component 330 will be in a "floating" position.

This position will allow the arms 325 of the holding arm component 320 to freely pivot. This further allows the arms 325 to pivot outwardly into the slanted surfaces 342.

It is observed that the downward force of the shoulder 314 of the engagement pin 310 against the sliding component 330 will cause the distal end 334 of the sliding component 330 to engage the proximal end 352 of the twisting component 350. Where the splines 335 of the sliding component engage the long slots 357, the spring 360 will force the twisting component 350 upwards along the top housing 340. At the same time, the sliding component is prevented from twisting because the splines 335 reside in the channels 346 along the inner diameter of the top housing 340.

Figure 6A:
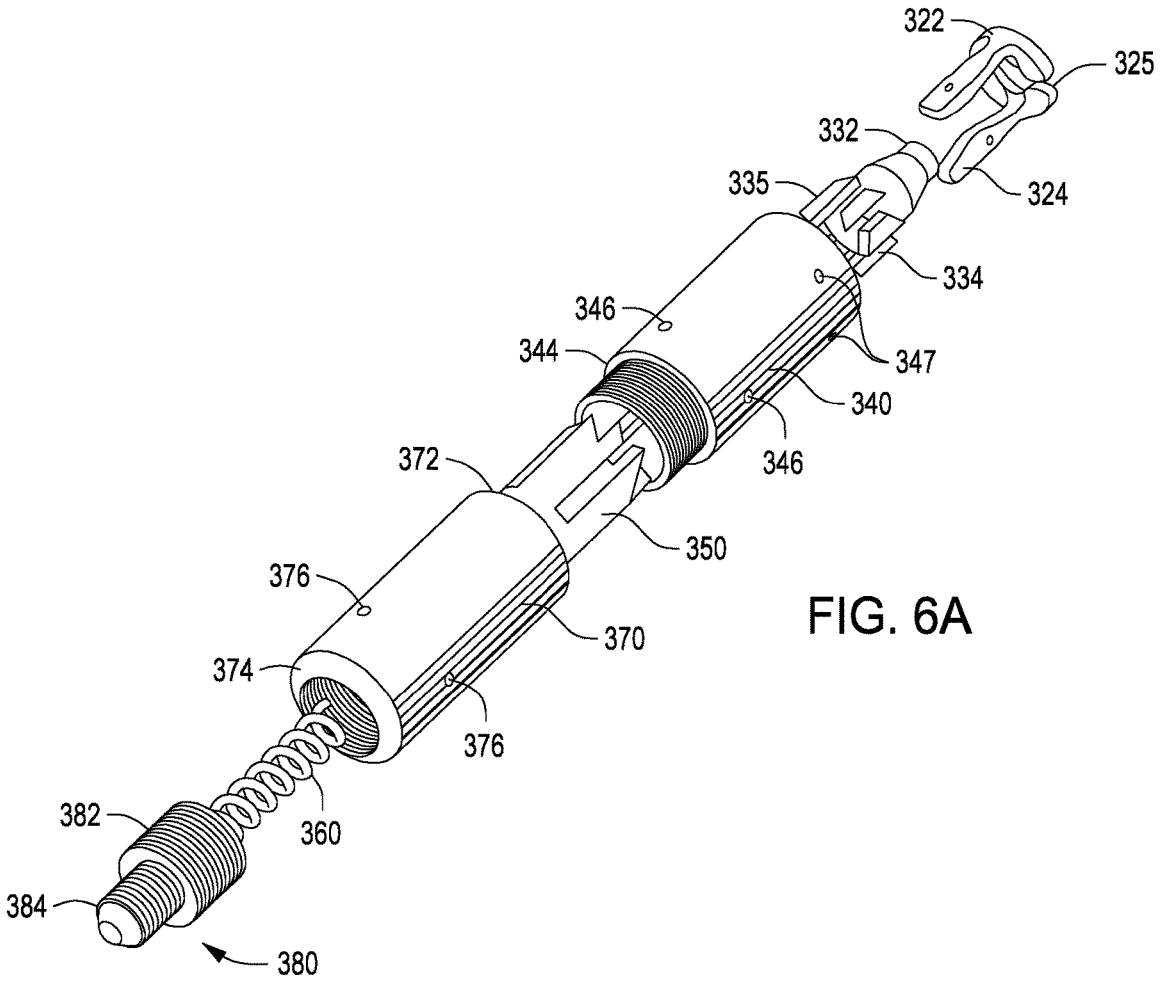
FIG. 6A is another perspective view of the standing valve puller of FIG. 3. Components of the standing valve puller are exploded apart. Here, the engagement pin is not shown.

FIG. 6A is another perspective view of the standing valve puller 300 of FIG. 3. Components of the standing valve puller 300 are partially exploded apart for illustrative purposes. Here, the engagement pin 310 is not shown. Visible are two of the pivot holes 347 in the top housing 340.

One or more holes 346 may be drilled into the top housing 340. These are drain holes. The drain holes 346 may allow fluids to drain from the puller 300 when the standing valve 164 is being pulled from a wellbore (See, for example, FIG. 9D in the parent application.)

Figure 6B:
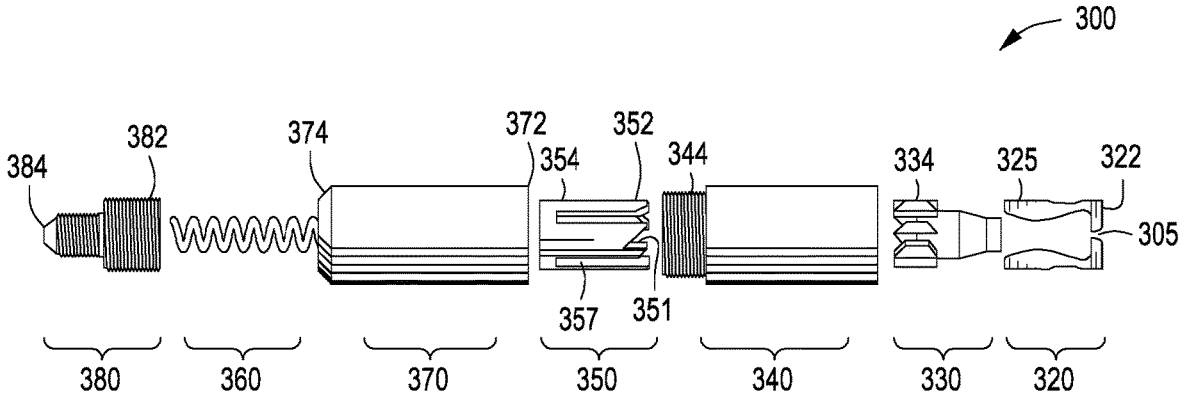
FIG. 6B is a side view of the exploded-apart components of the standing valve puller of FIG. 6A. Of interest, it can be seen that the arms of the holding arm component are independent (not connected) pieces.

FIG. 6B is a side view of the more-fully exploded-apart components of the standing valve puller 300 of FIG. 6A. Of interest, it can be seen that the arms 325 of the holding arm component 320 are independent (not connected) pieces that are able to pivot separately.

FIG. 7A is a perspective view of the top housing component 340, in one embodiment. The arms 325 are shown in their latched position at the upper end 342 of the top housing component 340. The arms are designed to pivot outwardly onto respective slanted surfaces, shown at 342 in FIG. 7B. An optional angled flat surface is provided at the back of each arm 325 for landing on a respective slanted surface 342.

FIG. 7B is a cross-sectional view of the top housing component 340 of FIG. 7A. Of interest, channels 348 are shown residing along an inner diameter of the top housing component 340. The channels 348 are configured to receive the splines 335 of the sliding component 330 during its travel up and down the top housing 340. The channels 348 also rotationally fix the sliding component 330 within the upper housing 340, as noted above.

Figure 8:
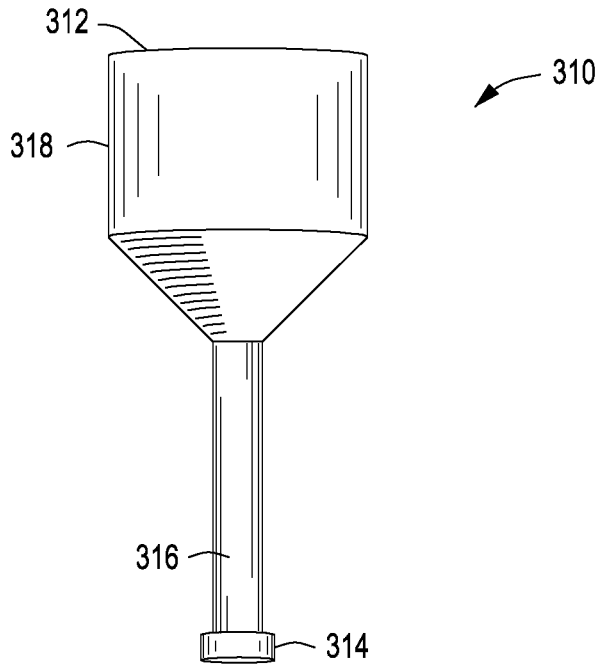
FIG. 8 is a side view of the holding arm component of the standing valve puller of FIG. 3. Here, the arms of the holding arm component have been pivoted into their open position, ready to receive an engagement pin. An engagement pin is shown above the holding arm component.
Figure 8:
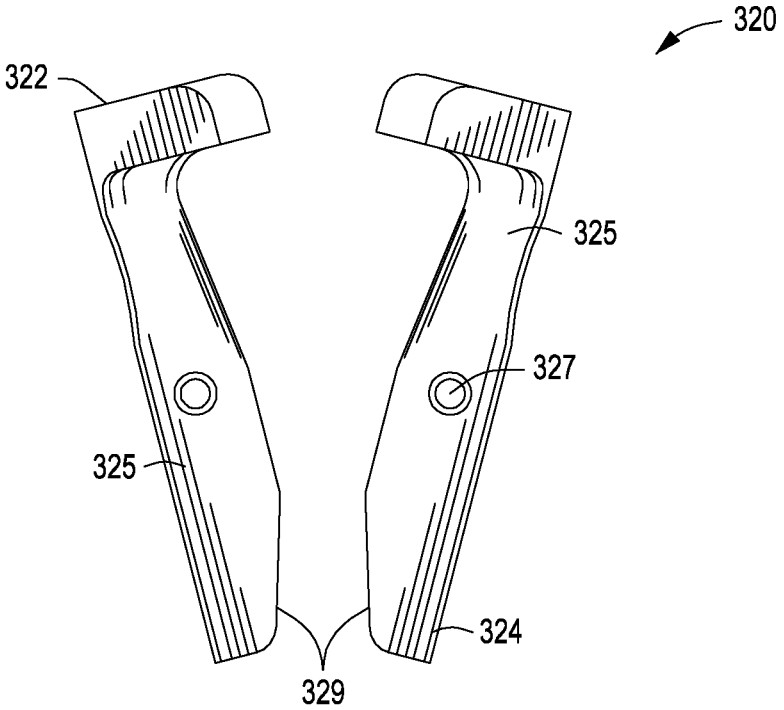

FIG. 8 is a perspective view of a holding arm component 320. In this view, the individual arms 325 have been pivoted outward into their "released" position. An engagement pin 310 is positioned above the holding arm component 320, ready to move down through a central bore of the standing valve puller 300 and to depress a sliding component (shown at 130 in drawings of the parent patent application of U.S. Ser. No. 15/901,429, and shown at 330 in FIG. 4 herein).

It is observed that a lower end 324 of each arm 325 includes a beveled inward surface 329. The beveled inward surface 329 accommodates the pivoting action of the arms 325, permitting the arms 325 to more fully pivot outwardly. At the same time, the beveled surfaces 329 receive the shoulder 314 when the engagement pin 310 is moved downwardly into the standing valve puller 300.

Of interest, through-openings 327 are shown through each of the arms 325. The through-openings 327 represent pivot points and are configured to receive a pivot pin (not shown). The pivot pins reside proximate a top of the top housing 340 of the puller 300. The horizontal pins allow the arms 325 to pivot inwardly and outwardly relative to the top housing 340.

The proximal end 312 of the engagement pin 310 comprises a somewhat tubular body 318. The body 318 serves as a box connector, meaning it offers female threads 315 within an opening. The body 318 threadedly connects to the lower end of a running string, such as coiled tubing or a sucker rod string. More preferably, the body 318 threadedly connects to the lower end of the traveling valve 162. In this way, the operator can use the existing rod string 124 and connected traveling valve 162 to engage the standing valve 164. Upon latching into the standing valve puller 300, an upward force is applied to the rod string 124 in order to unseat the standing valve 164. Again, this may be done without removing the rod string 124 from the wellbore 100 beforehand, as required using current technology.

Returning back to FIG. 3, additional features of the standing valve puller 300 are seen. These include the top housing 340 and the bottom housing 370. One or more holes 346 are drilled into the top housing 340. Similarly, holes 376 are formed in the bottom housing 370. These are drain holes that allow fluids to drain from the standing valve puller 300 as the standing valve 364 is being pulled from the wellbore 300.

When it is desirable to remove the standing valve 164, such as for maintenance, repair or replacement, the operator will use the standing valve puller 300 to latch onto the engagement pin 310 below the traveling valve 162. Specifically, the shoulder 114 will catch on the arms 125 of the holding arm component 120. The shoulder 114 will hit flanges at a proximal end 122 of the holding arms 120 when in their latched position. The operator will then pull the standing valve puller 300 and connected standing valve 164 from the wellbore 100 together. Thus, the standing valve puller 300 is configured to allow retrieval of the known standing valve 164 from the casing 128 using the traveling valve 164 itself, thereby saving a trip.

Additional components and features of the standing valve puller 300 are described in U.S. Ser. No. 15/901,429 incorporated herein and need not be repeated. The novel standing valve puller of the parent application allows a service company to pull the standing valve at any time while the sucker rods and traveling valve are still in the wellbore. In one embodiment, a pumper at the wellsite can lower the rod string 124 from the surface 105, connect to the standing valve puller 300 (using the engagement pin 310), unseat the standing valve 164 from the seating nipple 166, and circulate a hot oil treatment or a chemical treatment at the bottom of the wellbore 100, all without pulling the rod string 124 out of the hole. This may be a part of the step of Box 240B.

Of course, the operator may sometimes choose to remove the standing valve completely from the wellbore in accordance with the step of Boxes 270 and 280. This may be done by latching into the standing valve puller and then bringing the sucker rods up to the surface, joint-by-joint, with the traveling valve, the standing valve puller and the standing valve all connected together by means of threaded connections and the engagement pin. Thus, the invention of the parent application allows the traveling valve and standing valve to be pulled together in the same trip.

Returning to FIG. 2, the method 200 may include pumping a formation treating fluid down the production tubing. This is shown in connection with Box 290. Where the traveling valve and standing valve are opened downhole using a compressive force, the treatment step of Box 290 may be done without pulling the rod string, the traveling valve and the standing valve from the wellbore should the operator so choose.

The treatment fluid may be an acid designed to treat a subsurface formation below the standing valve. In that instance, the method 200 may include pumping the fluid down the production tubing, and then further pumping the fluid out of the wellbore (such as through perforations in the production casing) and into the surrounding subsurface formation. This is offered in Box 290.

Of course, the treatment fluid may again be a chemical designed to treat the valves and/or rod string for corrosion. The chemical is used to remove scale and to help ensure clean operation of the balls and seats within the pump valves.

After conducting well treatment operations, the method 200 may further comprise returning the polished rod to its original position relative to the pumping unit. This is shown at Box 220B. The step of Box 220B involves moving the harness and clamps to an original position along the polished rod.

Further, variations of the method of pumping fluid down a wellbore and across a seated tool may fall within the spirit of the claims, below. It will be appreciated that the inventions are susceptible to modification, variation and change without departing from the spirit thereof.

What is claimed is:

1. A method of pumping fluids down a wellbore, comprising:

providing a wellbore, the wellbore having been completed with a fluid pumping system comprising:

a polished rod, a string of production tubing within the wellbore, a sucker rod string extending from the polished rod and down into the production tubing, a traveling valve residing at a lower end of the sucker rod string, and a seated valve residing within the production tubing below the traveling valve;

adjusting a position of the polished rod relative to the pumping system to enable the sucker rod string and connected traveling valve to extend lower into the production tubing on a down stroke;

tagging the seated valve on the down stroke;

unseating the seated valve from the production tubing without pulling the rod string to the surface; and pumping a treating fluid down the production tubing, through the traveling valve and at least to the seated valve.

2. The method of claim 1, wherein:

the seated valve is a standing valve that is part of the fluid pumping system; and pumping the treating fluid down the production tubing comprises pumping the treating fluid through the seated valve.

3. The method of claim 2, wherein tagging the standing valve on the down stroke applies compression to the traveling valve, thereby mechanically opening the traveling valve.

4. The method of claim 3, wherein tagging the standing valve comprises compressing the rod string by at least two inches, thereby providing visual confirmation to an operator at a surface that the traveling valve is open.

5. The method of claim 4, wherein tagging the standing valve on the down stroke further applies compression to the standing valve, thereby also mechanically opening the standing valve.

6. The method of claim 5, wherein:

the treating fluid is a formation treatment fluid; and the method further comprises pumping the formation treatment fluid down the production tubing, across the traveling valve, through the seating valve, and into a subsurface formation.

7. The method of claim 3, wherein pumping the treating fluid down the production tubing is conducted while the seated valve remains seated.

8. The method of claim 7, wherein the treating fluid comprises a chemical designed to treat production equipment for scale or corrosion.

9. The method of claim 7, wherein the treating fluid is an acid or a heated oil.

10. The method of claim 2, wherein:

the pumping system comprises clamps and a harness used to secure a pumping unit to the polished rod; and adjusting a position of the polished rod relative to the pumping system comprises adjusting a location at which the harness is secured to the polished rod.

11. The method of claim 10, further comprising:

after pumping the treating fluid down the production tubing, moving the harness and clamps to an original position along the polished rod.

12. The method of claim 1, wherein:

the wellbore further comprises a standing valve puller configured to retrieve the standing valve from the wellbore, wherein the standing valve puller comprises:

a tubular housing comprising a proximal end and a distal end, and a bore there along;

a connector at the distal end of the tubular housing connected to the standing valve; and a holding arm component comprising at least two arms, wherein each of the at least two arms is configured to pivot at the proximal end of the tubular housing such that when an engagement pin located at a lower end of the traveling valve moves into the bore a first time, the arms pivot inwardly into a latched position and latch onto a shoulder of the engagement pin, but when the engagement pin moves into the bore a second time, the arms pivot outwardly to a released position and release the shoulder of the engagement pin.

13. The method of claim 12, wherein the standing valve puller further comprises:

a spring residing within the bore of the tubular housing and abutting the connector; and a sliding component configured to move along the bore of the tubular housing in response to a downward force applied by the engagement pin, wherein:

the sliding component includes a series of splines residing radially around an outer diameter of the sliding component; and downward movement of the engagement pin urges the sliding component to move downward within the tubular housing.

14. The method of claim 13, wherein: the step of tagging the traveling valve comprises lowering the engagement pin into the standing valve puller, thereby connecting the traveling valve with the standing valve puller; and the step of unseating the standing valve comprises raising the sucker rod string and connected traveling valve and traveling valve puller until the standing valve is released from a seating nipple.

15. The method of claim 14, wherein:

the treating fluid is a "kill fluid;" and the method further comprises killing the well using the kill fluid.

16. The method of claim 15, further comprising:

after killing the well, pulling the sucker rod string and connected traveling valve out of the wellbore.

17. A method of pumping fluids down a wellbore, comprising:

providing a wellbore, the wellbore having been completed with a fluid pumping system comprising:

a polished rod, a string of production tubing within the wellbore, a sucker rod string extending from the polished rod and down into the production tubing, a traveling valve residing at a lower end of the sucker rod string, and a standing valve residing within the production tubing below the traveling valve;

adjusting a position of the polished rod relative to the pumping system to enable the sucker rod string and connected traveling valve to extend lower into the production tubing on a down stroke tagging the standing valve on the down stroke, thereby applying compression to the traveling valve;

unseating the seated valve from the production tubing without pulling the rod string to the surface; and pumping a treating fluid down the production tubing, through the traveling valve, through the standing valve, and across a subsurface formation below the production tubing.

18. The method of claim 17, wherein:

tagging the standing valve comprises compressing the rod string by at least two inches, thereby mechanically opening both the traveling valve and the standing valve while providing visual confirmation to an operator at a surface that the traveling valve and the standing valve are both open.

19. The method of claim 18, wherein pumping the treating fluid down the production tubing is conducted while the standing valve remains seated.

20. The method of claim 17, wherein:

the treating fluid comprises (i) a chemical designed to treat production equipment for scale or corrosion, or (ii) an acid or a heated oil used to treat the subsurface formation;

a standing valve puller resides within the wellbore, and comprises:

a tubular housing comprising a proximal end and a distal end, and a bore there along; a connector at the distal end of the tubular housing connected to the standing valve; and a holding arm component comprising at least two arms, wherein each of the at least two arms is configured to pivot at the proximal end of the tubular housing such that when an engagement pin located at a lower end of the traveling valve moves into the bore a first time, the arms pivot inwardly into a latched position and latch onto a shoulder of the engagement pin, but when the engagement pin moves into the bore a second time, the arms pivot outwardly to a released position and release the shoulder of the engagement pin;

the step of tagging the traveling valve comprises lowering an engagement pin residing below the traveling valve into the standing valve puller, thereby connecting the traveling valve with the standing valve puller; and the step of unseating the standing valve comprises raising the sucker rod string and connected traveling valve and traveling valve puller until the standing valve is released from a seating nipple.

* * * * *